US008418610B2

(12) United States Patent
Schäfer et al.

(10) Patent No.: US 8,418,610 B2
(45) Date of Patent: Apr. 16, 2013

(54) PRINTING UNIT

(75) Inventors: Andre Schäfer, Augsburg (DE); Friedrich Steger, Augsburg (DE); Frank Wagner, Augsburg (DE)

(73) Assignee: manroland AG, Offenbach am Main (DE)

( * ) Notice: Subject to any disclaimer, the term of this patent is extended or adjusted under 35 U.S.C. 154(b) by 415 days.

(21) Appl. No.: 12/609,735

(22) Filed: Oct. 30, 2009

(65) Prior Publication Data

US 2010/0107913 A1 May 6, 2010

(30) Foreign Application Priority Data

Oct. 31, 2008 (DE) ..... 10 2008 054 192

(51) Int. Cl.
*B41F 5/00* (2006.01)

(52) U.S. Cl.
USPC ..... 101/216; 101/212

(58) Field of Classification Search ..... 101/216
See application file for complete search history.

(56) References Cited

U.S. PATENT DOCUMENTS

| | | | | |
|---|---|---|---|---|
| 4,306,419 | A * | 12/1981 | Schwartz | 62/6 |
| 4,563,605 | A * | 1/1986 | Gerber | 310/74 |
| 4,974,510 | A | 12/1990 | Fischer et al. | |
| 6,522,849 | B2 * | 2/2003 | Makino et al. | 399/159 |
| 6,794,791 | B2 * | 9/2004 | Ben Ahmed et al. | 310/268 |
| 6,796,475 | B2 * | 9/2004 | Adams | 227/2 |
| 6,817,292 | B2 * | 11/2004 | Gerner et al. | 101/217 |
| 6,942,651 | B2 * | 9/2005 | Gibbs | 604/389 |
| 7,121,205 | B2 * | 10/2006 | Ono et al. | 101/480 |
| 2003/0106445 | A1 * | 6/2003 | Weis | 101/216 |

FOREIGN PATENT DOCUMENTS

| | | |
|---|---|---|
| DD | 130 321 | 3/1978 |
| DE | 3 27 926 | 10/1920 |
| DE | 1 459 763 | 12/1968 |
| DE | 39 37 550 | 5/1990 |
| DE | 197 42 461 | 4/1999 |
| DE | 100 41 025 | 3/2002 |
| DE | 10 2005 058 786 | 6/2006 |
| DE | 10 2005 007 966 | 10/2006 |
| EP | 0 644 048 | 3/1995 |
| EP | 0 904 934 | 3/1999 |
| EP | 1 040 918 | 10/2000 |
| EP | 1 182 034 | 2/2002 |
| WO | WO 2006/089669 | 8/2006 |

* cited by examiner

*Primary Examiner* — Anthony Nguyen
(74) *Attorney, Agent, or Firm* — Cozen O'Connor

(57) ABSTRACT

A printing unit of a printing press, such as a web press constructed as a periodical printing press, having at least one printing couple, wherein the printing couple or each printing couple comprises a form cylinder, a transfer cylinder, an inking unit, and preferably a dampening unit. A drive motor is associated with at least one printing couple, and drives the form cylinder or the transfer cylinder of a respective printing couple. In accordance with the invention, a flywheel mass is associated with at least one drive motor which drives the form cylinder or the transfer cylinder of the respective printing couple, where the flywheel mass is connected to the rotor of the respective drive motor in a torsionally rigid manner.

10 Claims, 2 Drawing Sheets

PRINTING UNIT

BACKGROUND OF THE INVENTION

1. Field of the Invention

The invention is directed to a printing unit of a printing press and, more particularly, to a web press constructed as a periodical printing press.

2. Description of the Related Art

A printing unit of a web press constructed as a periodical printing press typically has two printing couples, where each printing couple comprises a transfer cylinder, a form cylinder, an inking unit and a dampening unit. The transfer cylinders are also called blanket cylinders, and the form cylinders are also known as plate cylinders. The transfer cylinders of the printing couples in a printing unit of this kind roll upon one another while forming a printing nip through which printing stock to be imprinted in the printing unit is conveyed in horizontal direction.

It known to provide each printing couple in a conventional printing unit with a separate drive motor that drives either the form cylinder or the transfer cylinder of the respective printing couple. Here, the drive motors of a drive unit preferably drive the transfer cylinders of the respective printing couples, and the form cylinder is then driven by way of the transfer cylinder.

In such a conventional printing unit, the mass inertia of the drive motor, together with the mass inertia of the cylinders to be driven by the drive motor, form an oscillating system having a certain natural frequency. When this oscillating system is excited by a frequency on the order of the natural frequency, vibrations develop which negatively impact the printing quality. Therefore, the drive controller of the respective drive motor is designed in such a way that it does not excite the oscillating system with its natural frequency. This is achieved in that the controller filters out, and therefore does not correct, interference in the load torque curve in the range of the natural frequency of the oscillating system.

However, since fluctuations in torque, which are not detected because of the filtering in the drive controller of the drive motor and can therefore not be corrected, can also act on the drive motor in the neighborhood of the natural frequency of the oscillating system, doubling can develop in the print area, which impairs printing quality.

SUMMARY OF THE INVENTION

It is therefore an object of the invention to improve the control quality of the drive in a printing unit of a printing press and, therefore, improve the printing quality. This and other objects and advantages in accordance with the invention are achieved by providing a printing unit the invention in which a flywheel mass is associated with at least one drive motor which drives the form cylinder or the transfer cylinder of the respective printing couple, where the flywheel mass is connected to the rotor of the respective drive motor to provide torsional rigidity.

In accordance with the invention, the flywheel mass is connected to the rotor of the respective drive motor in a rigid manner and, therefore, in a torsionally rigid manner. The mass moment of inertia of the drive motor is increased by this flywheel mass so that the natural frequency of the oscillating system comprising the drive motor and driven cylinders is also increased. As a result, the filter range of the filter of the drive controller of the respective drive motor is also raised. The drive controller of the drive motor can then better correct interference in a lower frequency range, i.e., in the range of the original natural frequency, so that a more stable control can be generally achieved. As a result, it becomes possible to prevent doubling in the print area to a great extent, and the printing quality can also be improved.

In particular, disadvantageous load states, such as backlash in the gear train of the cylinders to be driven by the drive motor and low-frequency interference, e.g., due to the inking unit, can be corrected in an improved manner.

Other objects and features of the present invention will become apparent from the following detailed description considered in conjunction with the accompanying drawings. It is to be understood, however, that the drawings are designed solely for purposes of illustration and not as a definition of the limits of the invention. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are indicated in, but are not limited by, the subclaims and the following description. An embodiment example of the invention will be explained in more detail with reference to the drawings without the invention being limited to these embodiment examples.

DETAILED DESCRIPTION OF THE PREFERRED EMBODIMENTS

The present invention is directed to a printing unit of a printing press, particularly a printing unit of a web press constructed as a periodical printing press. In alternative embodiments, the printing unit comprises a printing unit in a web press which is constructed as a newspaper printing press.

Figure 1:
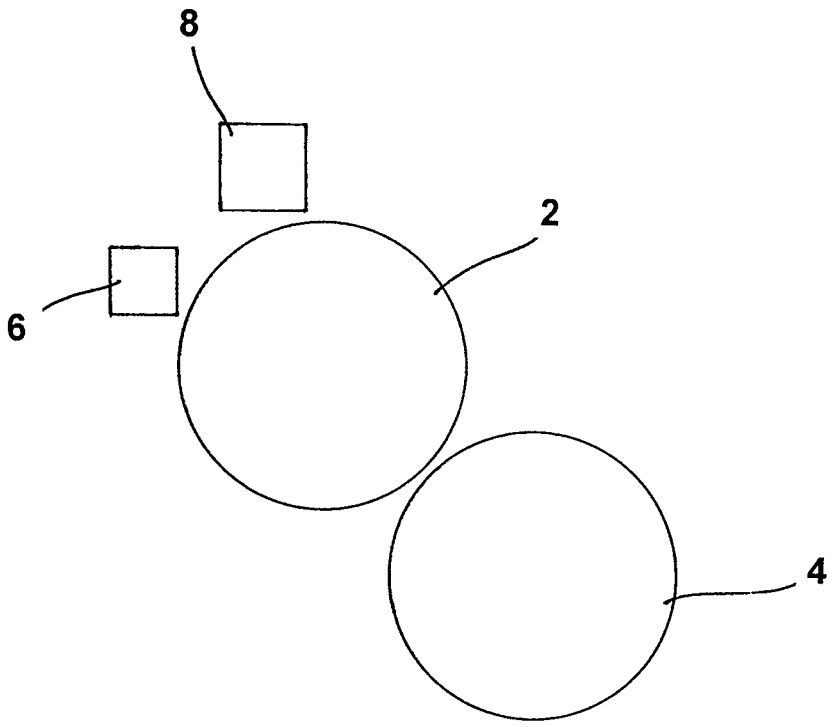
FIG. 1 is an exemplary schematic illustration of a printing couple of the invention.

A printing unit of a web press has a plurality of printing couples. As schematically shown in FIG. 1, each printing couple has a form cylinder 2, also known as a plate cylinder, a transfer cylinder 4, also known as a blanket cylinder, which rolls upon the form cylinder 2, an inking unit 6, and preferably a dampening unit 8+.

A separate drive motor is preferably associated with each printing couple in a printing unit of the type mentioned above, and drives either the form cylinder of the respective printing couple or the transfer cylinder of the respective printing couple. When the drive motor drives the transfer cylinder of the respective printing couple, the form cylinder of the respective printing couple is driven by the transfer cylinder by a toothed wheel connection.

Figure 2:
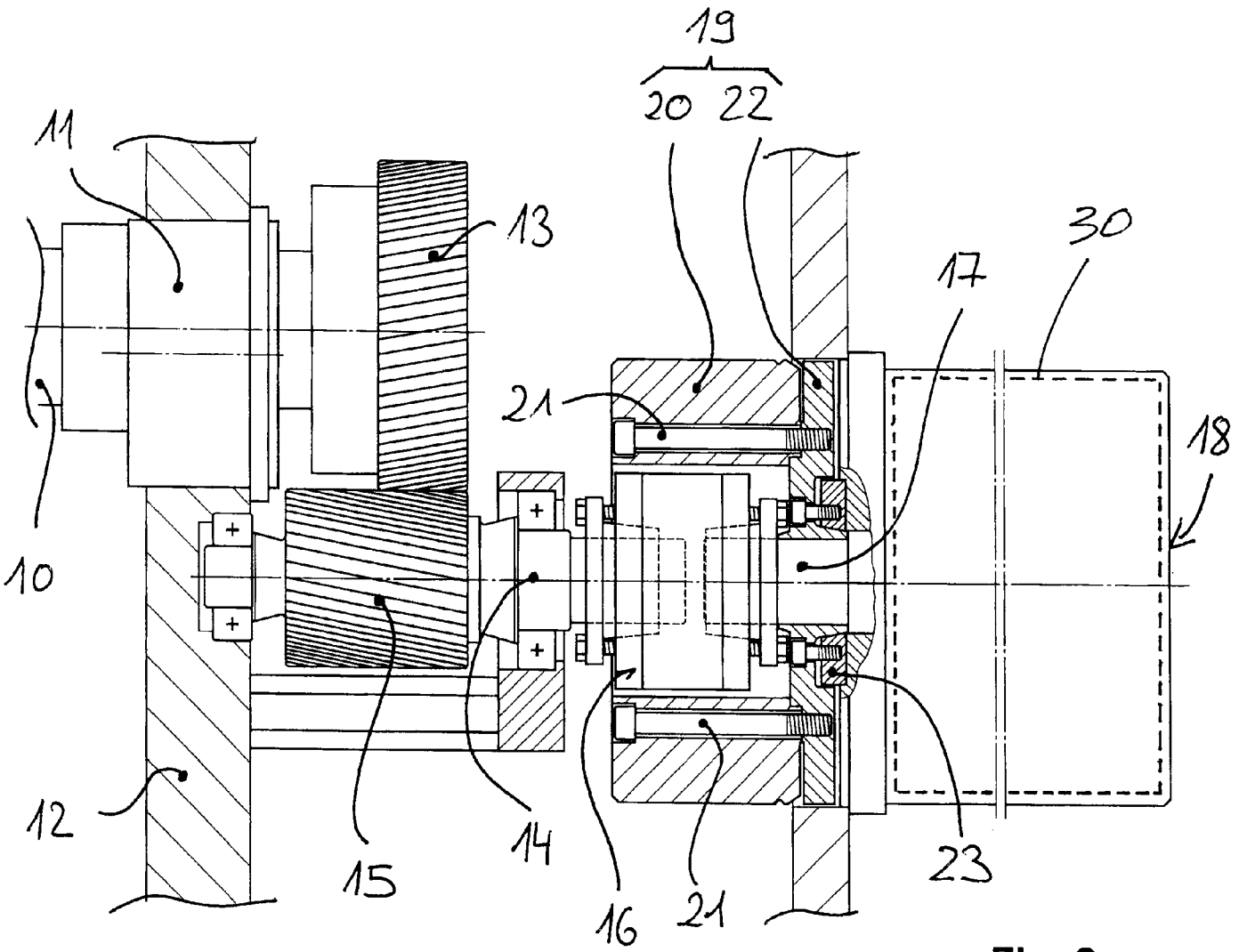
FIG. 2 shows a section from a printing unit in a printing press in accordance with the invention.

FIG. 2 shows a section from a printing unit in the area of a transfer cylinder in accordance with the invention. Here, however, only a shaft 10 of the transfer cylinder is shown in FIG. 2 for purposes of clarity. The shaft 10 is rotatably mounted in a side wall 12 of the printing unit by a bearing 11. A toothed wheel 13 is positioned on the shaft 10 of the transfer cylinder and meshes in a toothed wheel 15 which is positioned on a pinion shaft 14. The pinion shaft 14 is coupled to a motor shaft 17 of a drive motor 18 by a compensating coupling 16. Alignment errors between the pinion shaft 14 and the motor shaft 17 can be compensated by the compensating coupling 16.

In accordance with the invention, a flywheel mass 19 is associated with the drive motor 18 which engages in the transfer cylinder by way of the pinion shaft 14 in the FIG. 2.

As shown in FIG. 2, the flywheel mass 19 is connected in a torsionally rigid manner, or is rigidly connected, to the motor shaft 17 of the drive motor 18 and, therefore, to the rotor 30 thereof. The mass moment of inertia of the rotor 30 of the drive motor 18 is increased by the flywheel mass 19 so that the natural frequency of the oscillating system comprising the drive motor 18, pinion shaft 14 and transfer cylinder increases. Due to the increased natural frequency of this oscillating system, a filter range in a drive controller (not shown) of the drive motor 18, which filter range is based on the natural frequency of the oscillating system, can be shifted toward higher values so that interference or fluctuations in torque in a lower frequency range can be corrected better by the drive controller. As a result, it becomes possible to prevent doubling in the print area to a great extent, and the printing quality can also be improved.

In the presently contemplated exemplary embodiment, the flywheel mass 19 comprises a flywheel 20 which is connected so as to be stiff against torsion, and is rigidly connected by screws 21 to a disk 22 of the flywheel mass 19. The disk 22 to which the flywheel 20 is connected in a torsionally rigid manner, and is rigidly connected to the motor shaft 17 of the drive motor 18 by a connection member 23 (or bearing plate) which is shown constructed in FIG. 2 as a conical clamping hub.

In preferred embodiments, the flywheel mass 19 is constructed as a separate assembly with respect to the drive motor 18. As shown in the FIG. 2, the flywheel mass 19 is connected to the rotor 30 of the drive motor 18, i.e., to the motor shaft 17 thereof, such that the flywheel 20 concentrically encloses the compensating coupling 16. In alternative embodiments, the flywheel mass is integrated into the drive motor 18 such that it is positioned inside the housing of the drive motor and is connected in a torsionally rigid manner or is rigidly connected to the rotor of the drive motor 18.

As previously explained, in the preferred embodiment of the printing unit, the drive motor 18 having the flywheel mass which is connected in a torsionally rigid manner or is rigidly connected to the rotor 30 of the drive motor, is associated with each printing couple of the printing unit. In a printing unit of a periodical printing press comprising two printing couples in which the printing couples are not connected to one another by a toothed wheel engagement, a deviation in the synchronous running between the transfer cylinders of the printing couples and resulting doubling between the two printing couples of the printing unit can be prevented to a great extent. In addition, doubling between a plurality of printing units of a printing press can be prevented to a great extent.

In other embodiments, the flywheel mass is used in printing units in which at least one shared drive motor is associated with a plurality of printing couples of a printing unit which are connected to one another by a toothed wheel engagement. Here, the drive motor drives a form cylinder or a transfer cylinder of one of the printing couples with which at least one shared drive motor is associated. The flywheel mass, which is connected to the rotor of the respective drive motor in a torsionally rigid manner, is associated in turn with this drive motor. Accordingly, in a printing press comprising two or more printing units, a doubling between the printing units can be prevented to a great extent.

Thus, while there are shown, described and pointed out fundamental novel features of the invention as applied to preferred embodiments thereof, it will be understood that various omissions and substitutions and changes in the form and details of the illustrated apparatus, and in its operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice.

What is claimed is:

1. A printing unit of a printing press, comprising:

at least one printing couple comprising a form cylinder, a transfer cylinder and an inking unit;

at least one drive motor having a shaft and a rotor and being associated with at least one printing couple, said drive motor driving the form cylinder or the transfer cylinder of a respective printing couple;

a flywheel mass associated with the at least one drive motor which drives the form cylinder or the transfer cylinder of the respective printing couple, said flywheel mass being connected to the rotor of the respective drive motor in a torsionally rigid manner;

a disk; and a bearing plate connected to the shaft of the at least one drive motor;

wherein the flywheel mass comprises a flywheel which is connected to the disk so as to be fixed with respect to rotation relative to said disk, and wherein the disk is tightly connected to the bearing plate of the shaft of the rotor of the at least one drive motor so as to be fixed with respect to rotation relative to said bearing plate.

2. The printing unit according to claim 1, wherein the printing unit comprises a plurality of printing couples, wherein the at least one drive motor include a separate drive motor associated with each printing couple and drives the form cylinder or the transfer cylinder of the respective printing couple, and wherein the flywheel mass is associated with each separate drive motor and is connected to the rotor of a respective separate drive motor in the torsionally rigid manner.

3. The printing unit according to claim 1, wherein the printing unit comprises a plurality of printing couples, wherein the at least one drive motor includes at least one shared drive motor associated with at least two of the plurality of printing couples, said at least one shared drive motor driving a form cylinder or the transfer cylinder of one of the printing couples with which the at least one shared drive motor is associated, and wherein the flywheel mass is associated with each said at least one shared drive motor and is connected to the rotor of a respective shared drive motor in the torsionally rigid manner.

4. The printing unit according to claim 1, wherein the printing press comprises a web press.

5. The printing unit according to claim 4, wherein the web press comprises a periodical printing press.

6. The printing unit according to claim 1, wherein the printing press comprises a plurality of printing units.

7. The printing unit according to claim 1, wherein the at least one printing couple further comprises a dampening unit.

8. The printing unit according to claim 1, wherein the flywheel is rigidly connected by screws to the disk of the flywheel mass.

9. The printing unit according to claim 8, wherein the printing unit comprises a plurality of printing couples, wherein the at least one drive motor includes a separate drive motor associated with each printing couple and drives one of the form cylinder and the transfer cylinder of a respective printing couple, and wherein the flywheel mass is associated with each separate drive motor and is connected to the rotor of a respective separate drive motor in the torsionally rigid manner.

10. The printing unit according to claim 8, wherein the printing unit comprises a plurality of printing couples, wherein the at least one drive motor includes at least one shared drive motor associated with at least two of the plurality of printing couples, said at least one shared drive motor driving one of the form cylinder and the transfer cylinder of one of the printing couples with which the at least one shared drive motor is associated, and wherein the flywheel mass is associated with each said at least one shared drive motor and is connected to the rotor of a respective shared drive motor in the torsionally rigid manner.

* * * * *